US012790709B2

(12) United States Patent
Hamada et al.

(10) Patent No.: US 12,790,709 B2
(45) Date of Patent: Nov. 10, 2026

(54) PLATING METHOD AND PLATING APPARATUS

(71) Applicant: Tokyo Electron Limited, Tokyo (JP)

(72) Inventors: Masato Hamada, Kumamoto (JP); Masami Akimoto, Koshi (JP); Masatoshi Shiraishi, Kumamoto (JP); Satoshi Kaneko, Koshi (JP); Kazuki Motomatsu, Koshi (JP); Kazuyuki Goto, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 989 days.

(21) Appl. No.: 17/760,120

(22) PCT Filed: Feb. 1, 2021

(86) PCT No.: PCT/JP2021/003455
§ 371 (c)(1),
(2) Date: Aug. 4, 2022

(87) PCT Pub. No.: WO2021/157504
PCT Pub. Date: Aug. 12, 2021

(65) Prior Publication Data

US 2023/0042744 A1 Feb. 9, 2023

(30) Foreign Application Priority Data

Feb. 6, 2020 (JP) ..... 2020-019042

(51) Int. Cl.
*C25D 7/12* (2006.01)
*C25D 17/00* (2006.01)

(52) U.S. Cl.
CPC ..... *C25D 7/123* (2013.01); *C25D 17/001* (2013.01)

(58) Field of Classification Search
CPC ..... C25D 7/12–123; C25D 17/001; H01L 21/2885; H01L 21/76873; H01L 2224/11462
See application file for complete search history.

(56) References Cited

U.S. PATENT DOCUMENTS

2007/0158202 A1* 7/2007 Nagai ..... C25D 7/123 205/101
2015/0159289 A1 6/2015 Willey et al.
2015/0315720 A1 11/2015 Mayer et al.

FOREIGN PATENT DOCUMENTS

JP S52-70945 A 6/1977
JP S57-92191 A 6/1982
(Continued)

OTHER PUBLICATIONS

International Search Report for PCT/JP2021/003455 dated Apr. 13, 2021.

*Primary Examiner* — Hosung Chung
(74) *Attorney, Agent, or Firm* — Chrisman Gallo Tochtrop LLC

(57) ABSTRACT

A plating method includes holding a substrate, supplying a plating liquid L1, supplying a conductive liquid L2 and applying a voltage. In the holding of the substrate, the substrate is held. In the supplying of the plating liquid L1, the plating liquid L1 is supplied onto the held substrate. In the supplying of the conductive liquid L2, the conductive liquid L2, which is different from the plating liquid L1 supplied on the substrate, is supplied onto the plating liquid L1. In the applying of the voltage, the voltage is applied between the substrate and the conductive liquid L2.

6 Claims, 14 Drawing Sheets

(56) References Cited

FOREIGN PATENT DOCUMENTS

| | | | |
|---|---|---|---|
| JP | 2004-315889 | A | 11/2004 |
| JP | 2005-133160 | A | 5/2005 |
| KR | 10-2012-0100947 | A | 9/2012 |
| TW | 201336030 | A | 9/2013 |
| WO | 2011/036158 | A2 | 3/2011 |
| WO | 2012/050057 | A1 | 4/2012 |

* cited by examiner

PLATING METHOD AND PLATING APPARATUS

CROSS-REFERENCE TO RELATED APPLICATIONS

This application is a U.S. national phase application under 35 U.S.C. § 371 of PCT Application No. PCT/JP2021/003455 filed on Feb. 1, 2021, which claims the benefit of Japanese Patent Application No. 2020-019042 filed on Feb. 6, 2020, the entire disclosures of which are incorporated herein by reference.

TECHNICAL FIELD

The various aspects and embodiments described herein pertain generally to a plating method and a plating apparatus.

BACKGROUND

Conventionally, there is known a method of forming a plating film on a surface of a semiconductor wafer (hereinafter, simply referred to as a wafer) as a substrate by performing a plating processing while holding the wafer with a spin chuck (see, for example, Patent Document 1).

Patent Document 1: Japanese Patent Laid-open Publication No. 2005-133160

SUMMARY

In an exemplary embodiment, a plating method includes holding a substrate, supplying a plating liquid, supplying a conductive liquid and applying a voltage. In the holding of the substrate, the substrate is held. In the supplying of the plating liquid, the plating liquid is supplied onto the held substrate. In the supplying of the conductive liquid, the conductive liquid, which is different from the plating liquid supplied on the substrate, is supplied onto the plating liquid. In the applying of the voltage, the voltage is applied between the substrate and the conductive liquid.

DETAILED DESCRIPTION

Hereinafter, exemplary embodiments of a plating method and a plating apparatus according to the present disclosure will be described with reference to the accompanying drawings. The present disclosure is not limited to the exemplary embodiments to be described below. Further, it should be noted that the drawings are schematic and relations in sizes of individual components and ratios of the individual components may sometimes be different from actual values. Even between the drawings, there may exist parts having different dimensional relationships or different ratios.

Conventionally, there is known a method of forming a plating film on a surface of a semiconductor wafer (hereinafter, simply referred to as a wafer) as a substrate by performing a plating processing while holding the wafer with a spin chuck.

However, in the conventional plating processing, when a via is formed at the bottom of a trench formed on the surface of the wafer, the entrance of the via may be blocked as the plating film grows in the trench. As a result, there is a risk that the inside of the via may not be filled with the plating film.

In view of the foregoing, there is a demand for a technique enabling to successfully fill the via with the plating film by overcoming the aforementioned problem.

<Configuration of Plating Apparatus>

Figure 1:
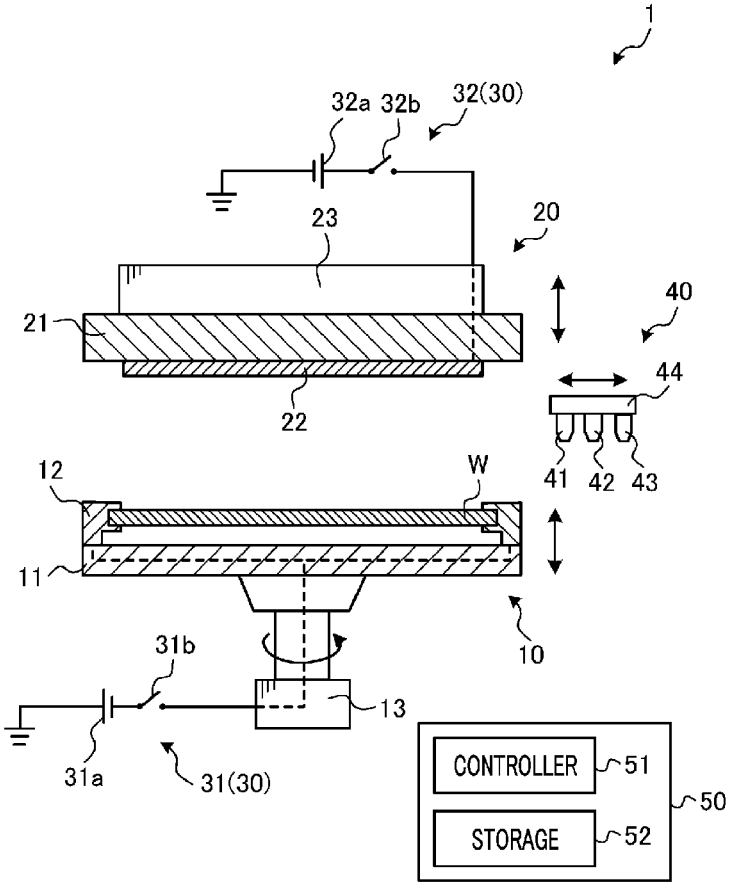
FIG. 1 is a diagram illustrating a schematic configuration of a plating apparatus according to an exemplary embodiment.

First, referring to FIG. 1, a configuration of a plating apparatus 1 according to an exemplary embodiment will be described. FIG. 1 is a diagram schematically illustrating the configuration of the plating apparatus 1 according to the exemplary embodiment.

In the plating apparatus 1, a plating processing is performed on a semiconductor wafer W (hereinafter, simply referred to as "wafer W") as a processing target substrate. The plating apparatus 1 includes a substrate holder 10, a plating unit 20, a voltage applying unit 30, a processing liquid supply 40, and a control device 50.

The substrate holder 10 is configured to hold the wafer W horizontally. The substrate holder 10 includes a base 11, a holder 12, and a driving mechanism 13. The base 11 is, for example, a spin chuck configured to hold and rotate the wafer W. The base 11 is of a substantially disk shape, and has a diameter larger than that of the wafer W when viewed from the top.

The holder 12 is provided on a top surface of the base 11, and is configured to hold the wafer W from the side thereof. The wafer W is horizontally held by this holder 12 while being slightly spaced apart from the top surface of the base 11. Further, the wafer W is held by the substrate holder 10 with its surface, on which a substrate processing is to be performed, facing upwards.

Furthermore, the holder 12 is provided with a cathode electrode (not shown). When holding the wafer W with the holder 12, this cathode electrode comes into contact with a seed layer 62 (see FIG. 2C) on the surface of the wafer W.

In addition, the cathode electrode is connected to the voltage applying unit 30 to be described later so that a predetermined voltage can be applied to the seed layer 62 on the surface of the wafer W which is in contact with the cathode electrode.

The substrate holder 10 is further equipped with the driving mechanism 13 having a motor or the like, and is thus capable of rotating the base 11 at a preset speed. Further, the driving mechanism 13 is provided with an elevational driving unit (not shown) such as a cylinder, and is thus capable of moving the base 11 in a vertical direction.

Above the substrate holder 10 described so far, the plating unit 20 is provided so as to face the top surface of the base 11. The plating unit 20 includes a base 21, an anode electrode 22, and a moving mechanism 23.

The base 21 is made of an insulating material. The base 21 has a substantially disk shape, and has a diameter larger than that of the wafer W when viewed from the top.

The anode electrode 22 is made of a conductive material and is provided on a bottom surface of the base 21. The anode electrode 22 is disposed to face the wafer W held by the substrate holder 10 substantially in parallel thereto.

When a voltage applying process is performed, the anode electrode 22 comes into direct contact with a conductive liquid L2 (see FIG. 3B) supplied on the wafer W. The anode electrode 22 is connected to the voltage applying unit 30 to be described later so that a predetermined voltage can be applied to the conductive liquid L2 which is in contact with the anode electrode 22.

The moving mechanism 23 is provided on top of the base 21. The moving mechanism 23 has, for example, an elevational driving unit (not shown) such as a cylinder. The moving mechanism 23 is capable of moving the whole plating unit 20 in the vertical direction by using the elevational driving unit.

The voltage applying unit 30 is configured to apply a predetermined voltage between the cathode electrode of the holder 12 and the anode electrode 22. The voltage applying unit 30 includes, for example, a negative voltage applying unit 31 and a positive voltage applying unit 32.

The negative voltage applying unit 31 is configured to apply a negative voltage to the cathode electrode of the holder 12. The negative voltage applying unit 31 has a DC power supply 31*a* and a switch 31*b*, and is connected to the cathode electrode of the holder 12. Specifically, a negative pole of the DC power supply 31*a* is connected to the cathode electrode of the holder 12 via a switch 31*b*, and a positive pole of the DC power supply 31*a* is grounded.

By turning the switch 31*b* into an on state, the negative voltage applying unit 31 is capable of applying a predetermined negative voltage to the cathode electrode of the holder 12.

The positive voltage applying unit 32 is configured to apply a positive voltage to the anode electrode 22. The positive voltage applying unit 32 has a DC power supply 32*a* and a switch 32*b*, and is connected to the anode electrode 22. To elaborate, a positive pole of the DC power supply 32*a* is connected to the anode electrode 22 via a switch 32*b*, and a negative pole of the DC power supply 32*a* is grounded.

By turning the switch 32*b* into an on state, the positive voltage applying unit 32 is capable of applying a preset positive voltage to the anode electrode 22.

The configuration of the voltage applying unit 30 is not limited to the example of FIG. 1, and the voltage applying unit 30 may have any configuration as long as the predetermined voltage can be applied between the cathode electrode of the holder 12 and the anode electrode 22.

The processing liquid supply 40 is provided between the substrate holder 10 and the plating unit 20, and is configured to supply various kinds of processing liquids onto the wafer W held by the substrate holder 10. The processing liquid supply 40 includes a first supply 41, a second supply 42, a third supply 43, and a moving mechanism 44.

The first supply 41 is, for example, a nozzle, and is configured to supply a plating liquid L1 (see FIG. 2B) onto the wafer W. The first supply 41 communicates with a plating liquid source (not shown) that stores therein the plating liquid L1. With this configuration, the processing liquid supply 40 is capable of supplying the plating liquid L1 from the plating liquid source to the first supply 41.

The second supply 42 is, by way of example, a nozzle, and is configured to supply the conductive liquid L2 (see FIG. 3A) onto the wafer W. The second supply 42 communicates with a conductive liquid source (not shown) that stores the conductive liquid L2 therein. With this configuration, the processing liquid supply 40 is capable of supplying the conductive liquid L2 from the conductive liquid source to the second supply 42.

The third supply 43 is, for example, a nozzle, and is configured to supply a cleaning liquid L3 (see FIG. 6) onto the wafer W. The third supply 43 communicates with a cleaning liquid source (not shown) that stores the cleaning liquid L3 therein. With this configuration, the processing liquid supply 40 is capable of supplying the cleaning liquid L3 from the cleaning liquid source to the third supply 43.

The moving mechanism 44 is capable of moving the first supply 41, the second supply 42 and the third supply 43 in the horizontal direction and the vertical direction. That is, the first supply 41, the second supply 42 and the third supply 43 are configured to advance to and retreat from the substrate holder 10.

The control device 50 is, by way of non-limiting example, a computer, and has a controller 51 and a storage 52. The controller 51 includes a microcomputer having a central processing unit (CPU), a read only memory (ROM), a random access memory (RAM), input/output ports, and so forth, and various kinds of circuits.

The CPU of this microcomputer reads out and executes a program stored in the ROM, thus carrying out a control over the various components of the plating apparatus 1 such as the substrate holder 10, the plating unit 20, the voltage applying unit 30, and the processing liquid supply 40.

Further, such a program may be recorded in a computer-readable recording medium, and may be installed from this recording medium to the storage 52 of the control device 50. Examples of the computer-readable recording medium include a hard disk (HD), a flexible disk (FD), a compact disk (CD), a magnet optical disk (MO), a memory card, and so forth.

The storage 52 is implemented by, for example, a semiconductor memory device such as a RAM or a flash memory, or a storage device such as a hard disk or an optical disk <Details of Plating Processing>

Figure 2A:
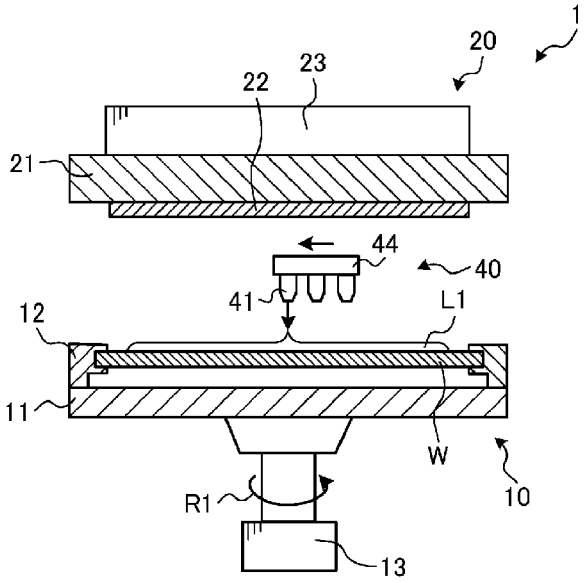
FIG. 2A is a diagram illustrating an outline of a substrate holding process and a first supplying process according to the exemplary embodiment.

Now, referring to FIG. 2A to FIG. 7, details of the plating processing performed in the plating apparatus 1 according to the exemplary embodiment will be described. In the plating processing according to the exemplary embodiment, a substrate holding process and a first supplying process are first performed. FIG. 2A is a diagram illustrating an outline of the substrate holding process and the first supplying process according to the exemplary embodiment.

First, a wafer W is transferred to the substrate holder 10 by using a non-illustrated transfer mechanism. The controller 51 (see FIG. 1) operates the holder 12 to perform the substrate holding process of holding the wafer W on the substrate holder 10.

Figure 2B:
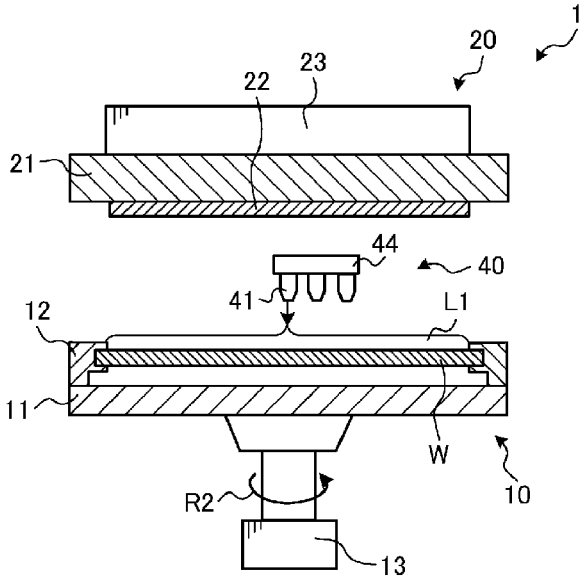
FIG. 2B is a diagram illustrating an outline of the first supplying process according to the exemplary embodiment.
Figure 2C:
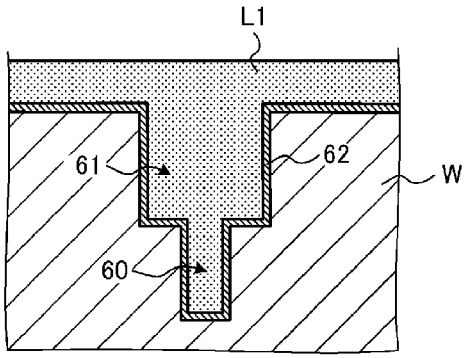
FIG. 2C is a diagram illustrating a state of a wafer after the first supplying process according to the exemplary embodiment.

Prior to this substrate holding process, a via 60 and a trench 61 are formed in a surface of the wafer W, as shown in FIG. 2C. FIG. 2C is a diagram showing a state of the wafer W after the completion of the first supplying process according to the exemplary embodiment.

In the exemplary embodiment, the via 60 is formed at the bottom of the trench 61, for example. The via 60 has a diameter of, e.g., about 20 nm, and the trench 61 has a width of, e.g., about 50 nm.

Further, prior to the substrate holding process, an insulating layer (not shown) of $SiO_2$ or the like, a barrier layer (not shown) of Ta, Ti or the like, and the seed layer 62 of Cu, Co, Ru or the like are formed on the surface of the wafer W in sequence from the bottom. Furthermore, in case of forming a Cu film as a plating film M (see FIG. 4B), Ta may be used as the barrier layer and Cu may be used as the seed layer 62.

Reference is made back to FIG. 2A. Following the substrate holding process, the first supplying process is performed in the plating apparatus 1. Specifically, by using the moving mechanism 44, the controller 51 moves the first supply 41 to a position above a central portion of the wafer W held by the substrate holder 10.

Subsequently, the controller 51 supplies the plating liquid L1 from the first supply 41 to the central portion of the wafer W, while rotating the wafer W at a predetermined rotation speed R1 (e.g., 50 rpm to 200 rpm) by using the driving mechanism 13.

Further, at a time point when the plating liquid L1 spreads over the entire surface of the wafer W, the controller 51 changes the rotation speed of the wafer W to a rotation speed R2 (e.g., 2 rpm to 10 rpm), as shown in FIG. 2B, and carries on the first supplying process. FIG. 2B is a diagram showing an outline of the first supplying process according to the exemplary embodiment. Thereafter, if the controller 51 stops the supply of the plating liquid L1 from the first supply 41, the first supplying process is ended.

Through this first supplying process, the inside of the via 60 and the inside of the trench 61 in the surface of the wafer W are filled with the plating liquid L1, and the surface of the wafer W is covered with the plating liquid L1, as depicted in FIG. 2C.

By way of example, when forming the Cu film as the plating film M (see FIG. 4B), the plating liquid L1 needs to contain copper ions and sulfate ions. Further, the plating liquid L1 supplied through the first supplying process has a thickness of, e.g., about 1 mm to 5 mm.

Figure 3A:
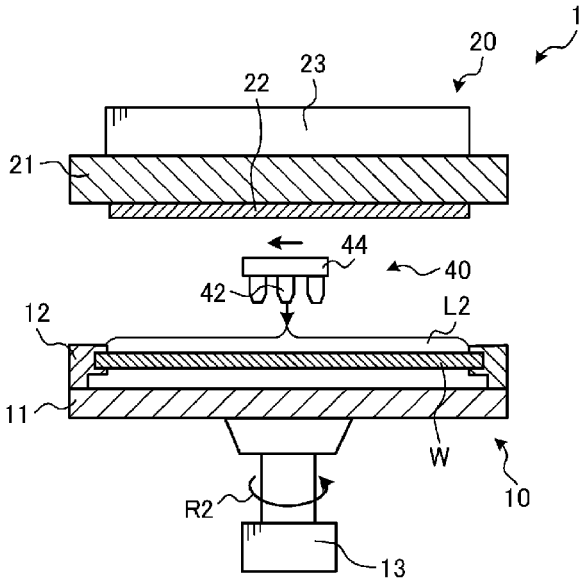
FIG. 3A is a diagram illustrating an outline of a second supplying process according to the exemplary embodiment.

Following the first supplying process, a second supplying process is performed in the plating processing according to the exemplary embodiment. FIG. 3A is a diagram illustrating an outline of the second supplying process according to the exemplary embodiment. Specifically, by using the moving mechanism 44, the controller 51 (see FIG. 1) first moves the second supply 42 to the position above the central portion of the wafer W held by the substrate holder 10.

Next, the controller 51 supplies the conductive liquid L2 to the central portion of the wafer W from the second supply 42, while rotating the wafer W at the predetermined rotation speed R2 by using the driving mechanism 13. Thereafter, if the controller 51 stops the supply of the conductive liquid L2 from the second supply 42, the second supplying process is ended.

Figure 3B:
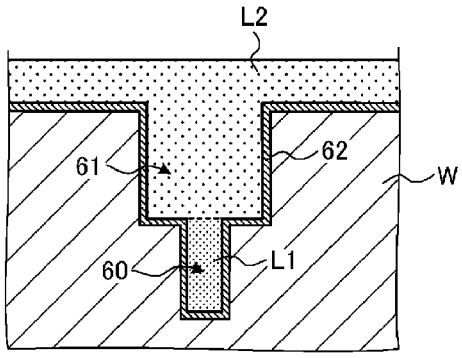
FIG. 3B is a diagram illustrating a state of the wafer after the second supplying process according to the exemplary embodiment.

Through this second supplying process, as shown in FIG. 3B, the plating liquid L1 accumulated on the surface of the wafer W is pushed out by the conductive liquid L2, so that the inside of the trench 61 and the surface of the wafer W are substantially filled with the conductive liquid L2. FIG. 3B is a diagram showing a state of the wafer W after the completion of the second supplying process according to the exemplary embodiment.

Meanwhile, since the entrance of the via 60 is narrower than that of the trench 61, the plating liquid L1 is not easily pushed out even when the second supplying process is performed. As a result, a large amount of the plating liquid L1 remains within the via 60.

The conductive liquid L2 is a liquid having conductivity. For example, the conductive liquid L2 is a plating liquid having a smaller content of a main component (for example, the copper ions) than the plating liquid L1. Further, the conductive liquid L2 may be a liquid containing ammonia or $CO_2$ (that is, ammonia water or a $CO_2$-containing liquid). The conductive liquid L2 supplied through the second supplying process has a thickness of, e.g., about 1 mm to 5 mm.

After the conductive liquid L2 is supplied onto the wafer W, the controller 51 moves the entire processing liquid supply 40 away from above the wafer W by using the moving mechanism 44. Further, in the substrate holding process, in the first supplying process, and in the second supplying process described above, the plating unit 20 is positioned apart from the substrate holder 10.

Figure 4A:
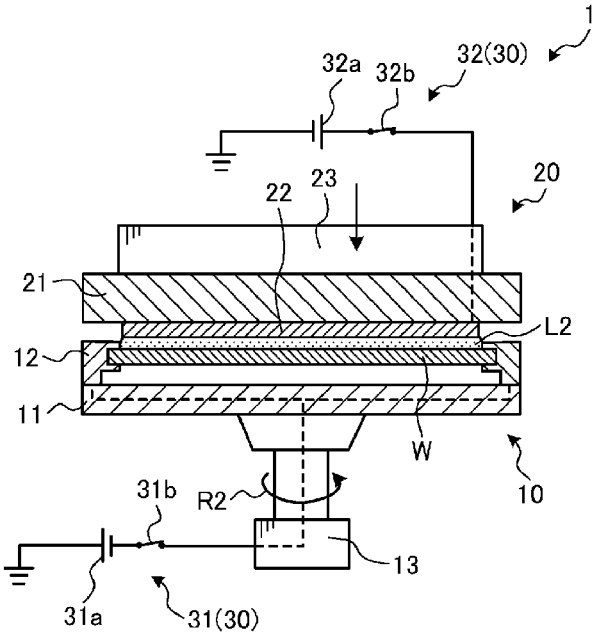
FIG. 4A is a diagram illustrating an outline of a voltage applying process according to the exemplary embodiment.

Following the second supplying process, a voltage applying process is performed in the plating processing according to the exemplary embodiment. FIG. 4A is a diagram showing an outline of the voltage applying process according to the exemplary embodiment.

To elaborate, while rotating the wafer W at the predetermined rotation speed R2 by using the driving mechanism 13, the controller 51 (see FIG. 1) brings the entire plating unit 20 close to the wafer W by using the moving mechanism 23, thus allowing the anode electrode 22 to come into contact with the conductive liquid L2 on the surface of the wafer W.

Next, the controller 51 turns the switch 31*b* and the switch 32*b* of the voltage applying unit 30 from the off state into the on state, while rotating the wafer W at the predetermined rotation speed R2 by using the driving mechanism 13.

Accordingly, the negative potential is applied to the cathode electrode of the holder 12, and the positive voltage is applied to the anode electrode 22. In this way, through the voltage applying process, the voltage applying unit 30 applies a preset voltage between the wafer W and the conductive liquid L2.

Figure 4B:
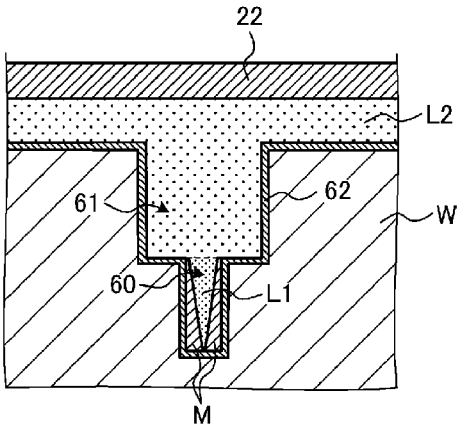
FIG. 4B is a diagram illustrating a state of the wafer after the voltage applying process according to the exemplary embodiment.

Accordingly, an electric field is formed within the plating liquid L1 through the conductive liquid L2, and the copper ions, which are positively charged particles, are accumulated at a surface side of the via 60, so that the plating film M is formed in the via 60, as depicted in FIG. 4B. FIG. 4B is a diagram showing a state of the wafer W after the completion of the voltage applying process according to the exemplary embodiment.

Meanwhile, in the voltage applying process according to the exemplary embodiment, since the amount of the plating liquid L1 remaining in the trench 61 and on the surface of the wafer W is small, the plating film M can be suppressed from being formed within the trench 61 and on the surface of the wafer W.

That is, in the plating processing according to the exemplary embodiment, as the preset voltage is applied after the conductive liquid L2 is further supplied on the plating liquid L1 on the surface of the wafer W, it is possible to selectively form the plating liquid M within the via 60.

Therefore, according to the exemplary embodiment, the plating film M can be formed inside the via 60 without blocking the entrance of the via 60, so that the inside of the via 60 can be successfully filled with the plating film M. After the voltage applying process is performed, the controller 51 separates the entire plating unit 20 away from the wafer W by using the moving mechanism 23.

In addition, in the exemplary embodiment, the first supplying process, the second supplying process, and the voltage applying process may be repeatedly performed in sequence multiple times.

Figure 5:
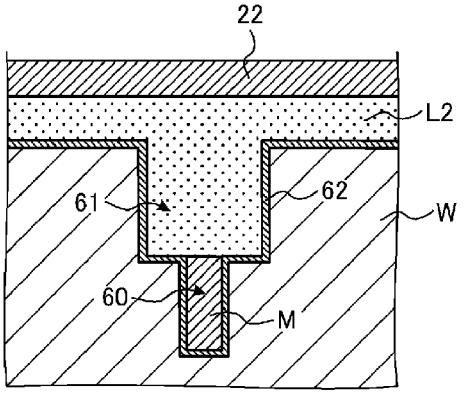
FIG. 5 is a diagram illustrating a state of the wafer after the first supplying process, the second supplying process, and the voltage applying process are repeatedly performed in sequence.

Accordingly, since the plating film M can be selectively formed within the via 60 multiple times, the inside of the via 60 can be filled with the plating film M reliably, as shown in FIG. 5. FIG. 5 is a diagram showing a state of the wafer W after the first supplying process, the second supplying process, and the voltage applying process according to the exemplary embodiment are repeatedly performed in sequence multiple times.

Furthermore, in the exemplary embodiment, the specific gravity of the conductive liquid L2 needs to be smaller than that of the plating liquid L1. Accordingly, the plating liquid L1 having a larger specific gravity tends to easily remain in the via 60 which is positioned lower than the trench 61, and it is possible to suppress the plating liquid L1 from being pushed out of the via 60.

Further, in the exemplary embodiment, since the specific gravity of the conductive liquid L2 is smaller than that of the plating liquid L1, liquid layers of the plating liquid L1 and the conductive liquid L2 are formed on the wafer W, thus allowing the plating liquid L1 to be easily left in the via 60.

Thus, according to the exemplary embodiment, since the plating film M can be more selectively formed inside the via 60, it is possible to fill the via 60 with the plating film M more successfully.

Further, in the exemplary embodiment, a plating liquid having a smaller content of the main component than the plating liquid L1 may be used as the conductive liquid L2 having the smaller specific gravity than the plating liquid L1. Accordingly, it is possible to suppress contamination of the surface of the wafer W or generation of an unintended reaction product due to the conductive liquid L2 during the voltage applying process.

Moreover, in the exemplary embodiment, a liquid containing ammonia or $CO_2$ may be used as the conductive liquid L2 having the smaller specific gravity than the plating liquid L1.

Figure 6:
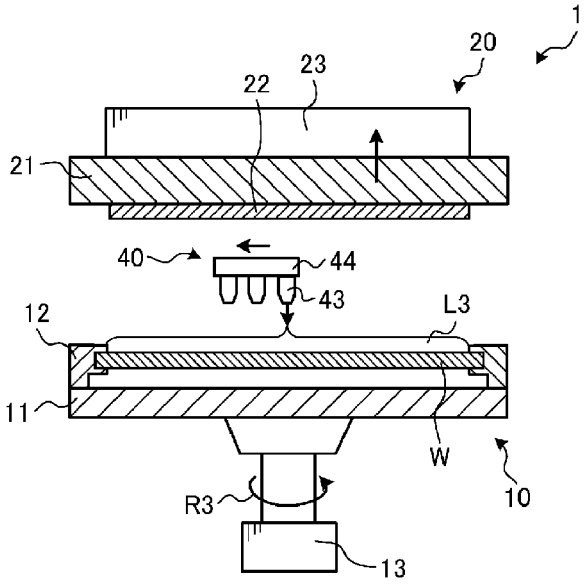
FIG. 6 is a diagram illustrating an outline of a substrate cleaning process according to the exemplary embodiment.

In the plating processing according to the exemplary embodiment, after the inside of the via 60 is filled with the plating film M, a substrate cleaning process is performed. FIG. 6 is a diagram illustrating an outline of the substrate cleaning process according to the exemplary embodiment. Specifically, by using the moving mechanism 44, the controller 51 (see FIG. 1) first moves the third supply 43 to the position above the central portion of the wafer W held by the substrate holder 10.

Then, the controller 51 supplies the cleaning liquid L3 to the central portion of the wafer W from the third supply 43, while rotating the wafer W at a predetermined rotation speed R3 (e.g., 500 rpm or higher) by using the driving mechanism 13. The cleaning liquid L3 is, for example, pure water. Thereafter, if the controller 51 stops the supply of the cleaning liquid L3 from the third supply 43, the substrate cleaning process is ended.

Through this substrate cleaning process, the plating liquid L1 and the conductive liquid L2 supplied on the wafer W are washed away, so that the surface of the wafer W is cleaned. Accordingly, the plating processing according to the exemplary embodiment is completed.

In the exemplary embodiment, after the first supplying process is performed to supply the plating liquid L1 onto the surface of the wafer W, a plating liquid reducing process may be performed to reduce the plating liquid L1 on the surface of the wafer W. In this plating liquid reducing process, by increasing the rotation speed of the wafer W from the rotation speed R2 to a predetermined rotation speed R4 (e.g., 200 rpm), the plating liquid L1 may be scattered to the extent that only a small amount of the plating liquid L1 is left on the surface of the wafer W.

By this plating liquid reducing process, it is possible to reduce the concentration of the plating liquid L1 on the surface of the wafer W and inside the trench 61 before the voltage applying process. Thus, formation of the plating film M on the surface of the wafer W and inside the trench 61 may be further suppressed.

Thus, according to the exemplary embodiment, since the plating film M can be more selectively formed within the via 60, the inside of the via 60 can be securely filled with the plating film M.

Further, in the present exemplary embodiment, after the first supplying process is performed to supply the plating liquid L1 onto the surface of the wafer W, a concentration reducing process of reducing the concentration of the plating liquid L1 on the surface of the wafer W may be performed. This concentration reducing process may be carried out by supplying the cleaning liquid L3 or the like onto the plating liquid L1 on the surface of the wafer W.

By this concentration reducing process, it is possible to reduce the concentration of the plating liquid L1 on the surface of the wafer W and inside the trench 61 before the voltage applying process. Thus, the formation of the plating film M on the surface of the wafer W and inside the trench 61 may be further suppressed.

Thus, according to the exemplary embodiment, since the plating film M can be more selectively formed within the via 60, the inside of the via 60 can be securely filled with the plating film M.

Figure 7:
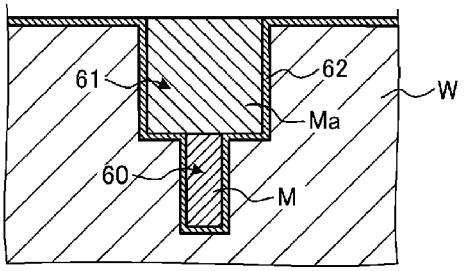
FIG. 7 is a diagram illustrating a state of the wafer upon the completion of all the required processes.

In addition, in the present disclosure, after performing the plating processing according to the exemplary embodiment, a conventional plating processing or the like may be performed on the wafer W to fill the trench 61 with a metal film Ma, as shown in FIG. 7. FIG. 7 is a diagram showing a state of the wafer W after all the required processes are completed. Through these processes, a high-quality multilayer wiring film can be formed on the wafer W.

Moreover, in the present disclosure, the anode electrode 22 having a size smaller than that of the wafer W may be provided in the plating unit 20, and the voltage applying process may be performed while scanning this anode electrode 22.

Various Modification Examples

Now, various modification example of the exemplary embodiment will be discussed with reference to FIG. 8 to FIG. 13. In the various modification examples that follows, parts identical to those of the exemplary embodiment will be assigned same reference numerals, and redundant description thereof will be omitted.

Figure 8:
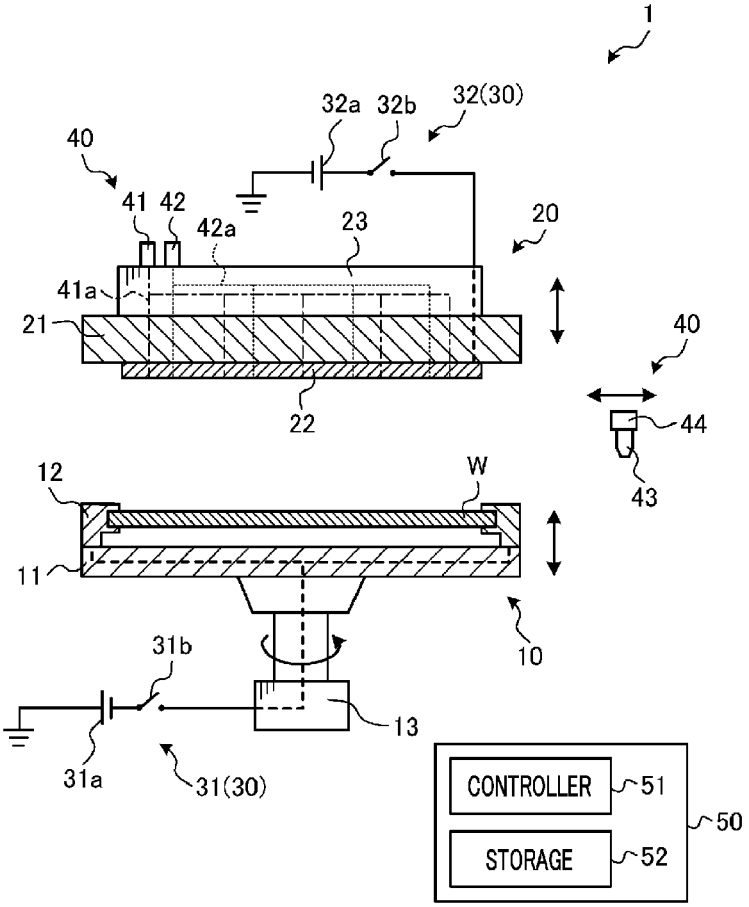
FIG. 8 is a diagram illustrating a schematic configuration of a plating apparatus according to a first modification example of the exemplary embodiment.

FIG. 8 is a diagram illustrating a schematic configuration of a plating apparatus 1 according to a first modification example of the exemplary embodiment. As shown in FIG. 8, in the first modification example, the configurations of the plating unit 20 and the processing liquid supply 40 are different from those of the exemplary embodiment.

To elaborate, in the plating apparatus 1 according to the first modification example, the first supply 41 and the second supply 42 of the processing liquid supply 40 are not provided in the moving mechanism 44 but provided in the plating unit 20. Meanwhile, the third supply 43 is configured to be moved back and forth with respect to the substrate holder 10 by the moving mechanism 44, the same as in the exemplary embodiment.

Further, in the first modification example, a flow path 41*a* through which the plating liquid L1 is supplied from the first supply 41 to the wafer W is formed in the plating unit 20, and a flow path 42*a* through which the conductive liquid L2 is supplied from the second supply 42 to the wafer W is formed in the plating unit 20.

Figure 9:
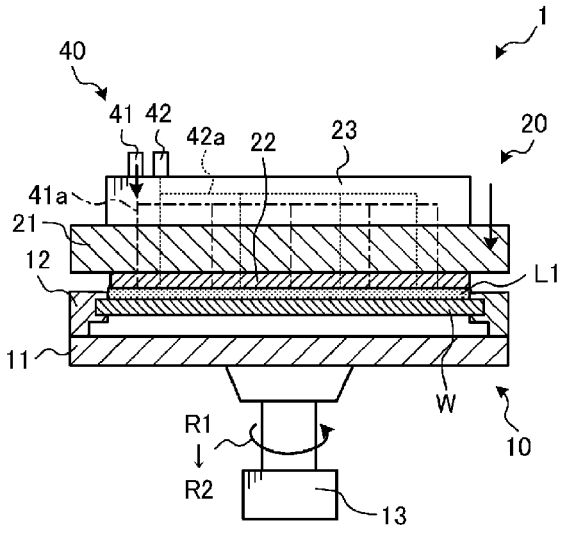
FIG. 9 is a diagram illustrating an outline of a substrate holding process and a first supplying process according to the first modification example of the exemplary embodiment.

Now, details of a plating processing performed by the plating apparatus 1 according to the first modification example will be described. FIG. 9 is a diagram showing an outline of a substrate holding process and a first supplying process according to the first modification example of the exemplary embodiment.

First, the wafer W is transferred to the substrate holder 10 by using the non-illustrated transfer mechanism. Then, the controller 51 (see FIG. 8) operates the holder 12 to perform the substrate holding process of holding the wafer W with the substrate holder 10.

Following this substrate holding process, the first supplying process is performed in the plating apparatus 1 according to the first modification example. First, the controller 51 brings the entire plating unit 20 close to the wafer W by using the moving mechanism 23.

At this time, the controller 51 brings the entire plating unit 20 close to the wafer W such that the distance between the wafer W and the anode electrode 22 becomes a predetermined distance (e.g., 1 mm to 5 mm).

Next, the controller 51 supplies the plating liquid L1 from the first supply 41 into a gap between the wafer W and the anode electrode 22 through the first flow path 41*a*, while rotating the wafer W at the predetermined rotation speed R1 by using the driving mechanism 13.

Further, the controller 51 changes the rotation speed of the wafer W to the rotation speed R2 at a time point when the plating liquid L1 spreads over the entire surface of the wafer W, and carries on the first supplying process. Then, if the controller 51 stops the supply of the plating liquid L1 from the first supply 41, the first supplying process is ended.

Through this first supplying process, the inside of the via 60 and the inside of the trench 61 on the surface of the wafer W are filled with the plating liquid L1, and the surface of the wafer W is covered with the plating liquid L1, as shown in FIG. 2C of the exemplary embodiment.

Figure 10:
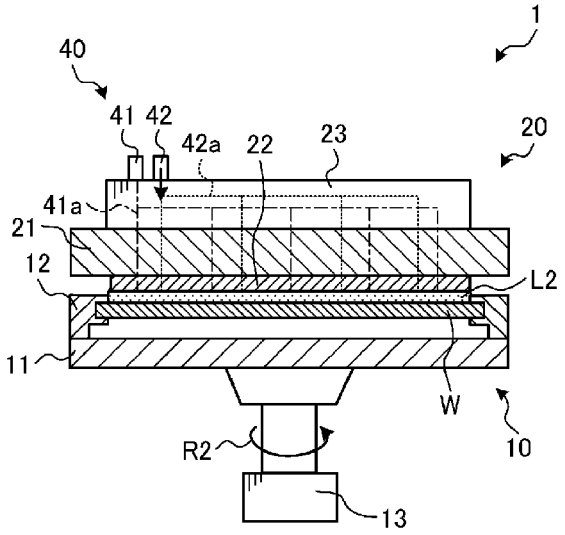
FIG. 10 is a diagram illustrating an outline of a second supplying process according to the first modification example of the exemplary embodiment.

Following the first supplying process, the second supplying process is performed in the plating processing according to first modification example. FIG. 10 is a diagram showing an outline of the second supplying process according to the first modification example of the exemplary embodiment.

Specifically, the controller 51 (see FIG. 8) supplies the conductive liquid L2 from the second supply 42 into the gap between the wafer W and the anode electrode 22 through the flow path 42*a*, while rotating the wafer W at the predetermined rotation speed R2 by using the driving mechanism 13.

Then, if the controller 51 stops the supply of the conductive liquid L2 from the second supply 42, the second supplying process is ended.

Through this second supplying process, the plating liquid L1 accumulated on the surface of the wafer W is pushed out by the conductive liquid L2, and the inside of the trench 61 and the surface of the wafer W are substantially filled with the conductive liquid L2, as illustrated in FIG. 3B.

Meanwhile, since the entrance of the via 60 is narrower than that of the trench 61, the plating liquid L1 is not easily pushed out even when the second supplying process is performed. As a result, a large amount of the plating liquid L1 remains within the via 60.

Figure 11:
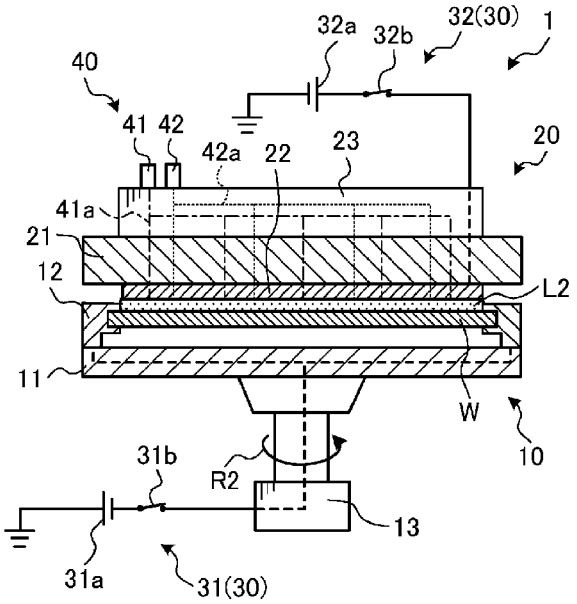
FIG. 11 is a diagram illustrating an outline of a voltage applying process according to the first modification example of the exemplary embodiment.

Following the second supplying process, the voltage applying process is performed in the plating processing according to the first modification example. FIG. 11 is a diagram illustrating an outline of the voltage applying process according to the first modification example of the exemplary embodiment.

Specifically, the controller 51 (see FIG. 8) turns the switches 31*b* and 32*b* of the voltage applying unit 30 into the on state from the off state, while rotating the wafer W at the predetermined rotation speed R2 by using the driving mechanism 13. Accordingly, the voltage applying unit 30 applies a preset voltage between the wafer W and the conductive liquid L2.

As a result, an electric field is formed within the plating liquid L1 through the conductive liquid L2, and the copper ions, which are positively charged particles, are accumulated at the surface side of the via 60, so that the plating film M is formed inside the via 60, as shown in FIG. 4B of the exemplary embodiment.

In addition, in the voltage applying process according to the first modification example, the amount of the plating liquid L1 remaining in the trench 61 and on the surface of the wafer W is small, the same as in the exemplary embodiment. Therefore, the formation of the plating film M within the trench 61 and on the surface of the wafer W may be suppressed.

That is, in the plating processing according to the first modification example, by applying the preset voltage after supplying the conductive liquid L2 onto the plating liquid L1 on the wafer W, it is possible to selectively form the plating film M within the via 60.

Therefore, according to the first modification example, the plating film M can be formed within the via 60 without blocking the entrance of the via 60. Therefore, the inside of the via 60 may be securely filled with the plating film M.

Furthermore, in the first modification example, the plating liquid L1 and the conductive liquid L2 can be supplied onto the wafer W through the flow paths 41*a* and 42*a* that are formed in the plating unit 20. Accordingly, in the first modification example, the processes from the first supplying process to the voltage applying process can be continuously performed without moving the plating unit 20.

Thus, according to the first modification example, the time required for the plating processing for the wafer W may be shortened.

In addition, in the first modification example, since the subsequence process can be promptly performed after the first supplying process, it is possible to suppress the seed layer 62 on the surface of the wafer W from being dissolved by the plating liquid L1 before the subsequent process is begun.

Furthermore, in the first modification example, after performing the voltage applying process, the processes from the first supplying process to the voltage applying process may be repeatedly performed in sequence. Accordingly, the plating film M can be selectively formed within the via 60 multiple times, so that the inside of the via 60 may be securely filled with the plating film M, as depicted in FIG. 5.

Additionally, when repeatedly performing the processes from the first supplying process to the voltage applying process in sequence in the first modification example after performing the voltage applying process, the individual processes can be performed repeatedly without moving the plating unit 20 to other places.

That is, in the first modification example, even when the processes from the first supplying process to the voltage applying process are repeatedly performed in sequence, the time required for the whole plating processing for the wafer W may be shortened.

Further, in the first modification example, the conductive liquid L2 needs to have the specific gravity smaller than that of the plating liquid L1, the same as in the exemplary embodiment. Accordingly, the plating film M may be more selectively formed within the via 60, so that the inside of the via 60 may be securely filled with the plating film M.

Furthermore, in the first modification example, the plating liquid having the smaller content of the main component than the plating liquid L1 may be used as the conductive liquid L2 having the smaller specific gravity than the plating liquid L1, the same as in the exemplary embodiment. Accordingly, it is possible to suppress the contamination of the surface of the wafer W or the generation of the unintended reaction product due to the conductive liquid L2 during the voltage applying process.

Figure 12:
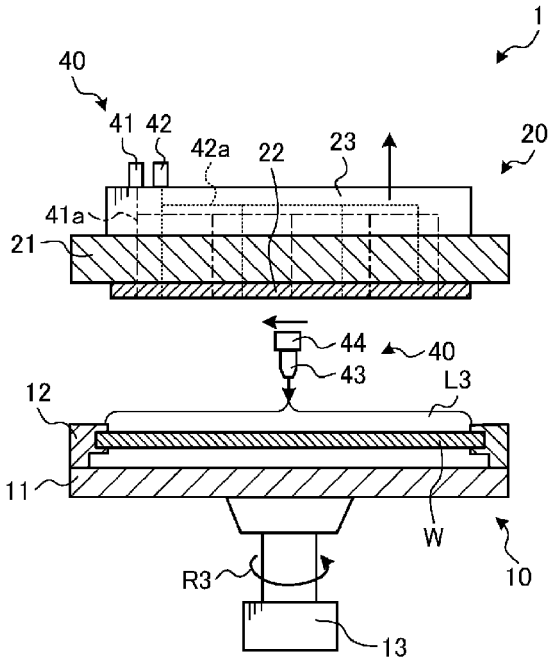
FIG. 12 is a diagram illustrating an outline of a substrate cleaning process according to the first modification example of the exemplary embodiment.

In the plating processing according to the first modification example, after the inside of the via 60 is filled with the plating film M, the substrate cleaning process is performed. FIG. 12 is a diagram illustrating an outline of the substrate cleaning process according to the first modification example of the exemplary embodiment.

Specifically, the controller 51 (see FIG. 8) first moves the entire plating unit 20 away from above the wafer W by using the moving mechanism 23, and moves the third supply 43 by using the moving mechanism 44 up to the position above the central portion of the wafer W held by the substrate holder 10.

Subsequently, the controller 51 supplies the cleaning liquid L3 from the third supply 43 onto the central portion of the wafer W, while rotating the wafer W at the predetermined rotation speed R3 by using the driving mechanism 13. Then, if the controller 51 stops the supply of the cleaning liquid L3 from the third supply 43, the substrate cleaning process is ended.

In the first modification example described so far, the plating liquid reducing process or the concentration reducing process may be performed between the first supplying process and the second supplying process, the same as in the exemplary embodiment.

Figure 13:
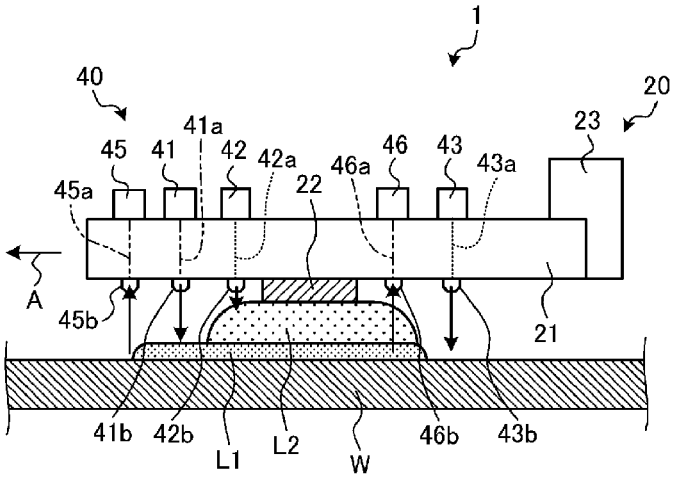
FIG. 13 is a diagram illustrating a schematic configuration of a plating apparatus according to a second modification example of the exemplary embodiment.

FIG. 13 is a diagram illustrating a schematic configuration of a plating apparatus 1 according to a second modification example of the exemplary embodiment. In the plating apparatus 1 according to the second modification example, a plating processing is performed by using the plating unit 20 having a bar nozzle shape.

The plating unit 20 of the second modification example has a rod-shaped base 21 extending in a direction substantially perpendicular to a traveling direction A. This plating unit 20 is provided with, in a lower portion of the base 21, a plurality of suction openings 45*b*, a plurality of discharge openings 41*b*, a plurality of discharge openings 42*b*, the anode electrode 22, a plurality of suction openings 46*b*, and a plurality of discharge openings 43*b*.

The plurality of suction openings 45*b* are connected to a suction mechanism 45 through a flow path 45*a*. In the plating unit 20 of the second modification example, by operating this suction mechanism 45, the processing liquid or the like can be sucked from the plurality of suction openings 45*b*.

The plurality of discharge openings 41*b* are connected to the first supply 41 through a flow path 41*a*, and the plurality of discharge openings 42*b* are connected to the second supply 42 through a flow path 42*a*.

Further, the plurality of suction openings 46*b* are connected to a suction mechanism 46 through a flow path 46*a*. In the plating unit 20 of the second modification example, by operating this suction mechanism 46, the processing liquid or the like can be sucked from the plurality of suction openings 46*b*. The plurality of discharge openings 43*b* are connected to the third supply 43 through a flow path 43*a*.

The plurality of suction openings 45*b*, the plurality of discharge openings 41*b*, the plurality of discharge openings 42*b*, the plurality of suction openings 46*b*, and the plurality of discharge openings 43*b* are arranged along a lengthwise direction of the base 21. Further, the anode electrode 22 is provided along the lengthwise direction of the base 21.

In addition, the plurality of suction openings 45*b*, the plurality of discharge openings 41*b*, the plurality of discharge openings 42*b*, the anode electrode 22, the plurality of suction openings 46*b*, and the plurality of discharge openings 43*b* are provided in the lower portion of the base 21 in sequence from the front side in the travelling direction A.

Now, a plating processing performed in the plating apparatus 1 of the second modification example will be described. First, the controller 51 (see FIG. 1) scans the base 21 along the traveling direction A from above the wafer W by using the moving mechanism 23.

Then, in the second modification example, the plating liquid L1 is discharged from the plurality of discharge openings 41*b*, and the conductive liquid L2 is discharged on the plating liquid L1 from the plurality of discharge opening 42*b* located at the rear of the plurality of discharge openings 41*b*.

Accordingly, in the plating apparatus 1 according to the second modification example, the first supplying process and the second supplying process may be simultaneously performed on the surface of the wafer W.

In addition, by operating the voltage applying unit 30 (see FIG. 1), the controller 51 applies the negative potential to the cathode electrode of the holder 12 (see FIG. 1) and the positive voltage to the anode electrode 22. Accordingly, the controller 51 is capable of performing the voltage applying process of applying a preset voltage between the wafer W and the conductive liquid L2 at the rear of the plurality of discharge openings 42*b*.

Further, the controller 51 operates the suction mechanism 45 to suck in the cleaning liquid L3 (see FIG. 6) positioned in a front side of the plating unit 20. Accordingly, even if the cleaning liquid L3 or the like is present on the surface of the wafer W, it is possible to suppress the plating liquid L1 from being diluted by the cleaning liquid. Thus, according to the second modification example, plating processing may be stably performed.

Further, the controller 51 operates the suction mechanism 46 to recover the plating liquid L1 and the conductive liquid L2 to which the preset voltage is applied from the rear of the anode electrode 22, and also operates the third supply 43 to discharge the cleaning liquid L3 from the plurality of discharge openings 43*b*.

Accordingly, since the surface of the wafer W can be covered with the cleaning liquid L3, the cleanliness of the surface of the wafer W may be maintained by the cleaning liquid L3 without needing to dry the surface of the wafer W.

As described so far, in the plating apparatus 1 according to the second modification example, the first supplying process, the second supplying process, and the voltage applying process may be performed simultaneously while scanning the wafer W in the traveling direction A in the bar nozzle-shaped plating unit 20.

Thus, according to the second modification example, the time required for the plating processing for the wafer W may be shortened.

In addition, in the second modification example, since the first supplying process, the second supplying process, and the voltage applying process can be performed at the same time, it is possible to suppress the seed layer 62 on the surface of the wafer W from being dissolved by the plating liquid L1.

The plating apparatus 1 according to the exemplary embodiment includes the substrate holder 10, the first supply 41, the second supply 42, the voltage applying unit 30, and the controller 51. The substrate holder 10 holds the substrate (wafer W). The first supply 41 supplies the plating liquid L1 onto the substrate (wafer W). The second supply 42 supplies the conductive liquid L2 different from the plating liquid L1 onto the substrate (wafer W). The voltage applying unit 30 applies the voltage. The controller 51 controls the individual components. Furthermore, the controller 51 holds the substrate (wafer W) by the substrate holder 10, and supplies the plating liquid L1 onto the held substrate (wafer W) by the first supply 41. In addition, the controller 51 supplies the conductive liquid L2 onto the plating liquid L1 supplied on the substrate (wafer W) by the second supply 42, and applies the voltage between the substrate (wafer W) and the conductive liquid L2 by the voltage applying unit 30. As a result, the inside of the via 60 may be securely filled with the plating film M.

<Sequence of Processing>

Figure 14:
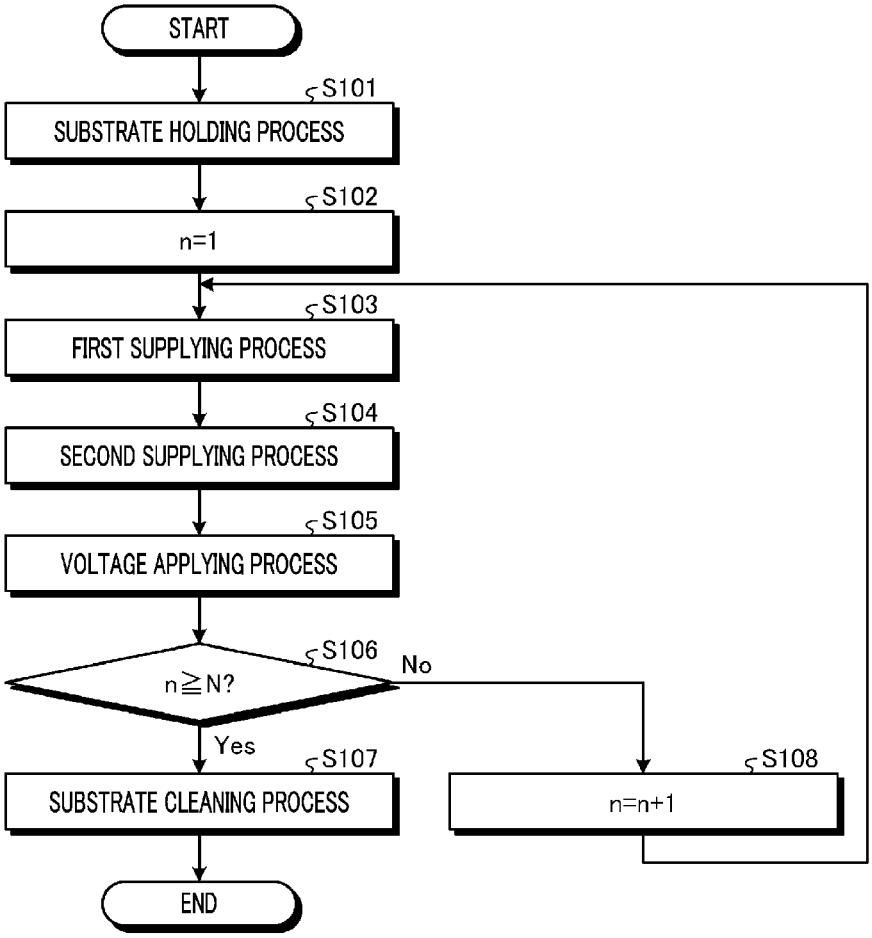
FIG. 14 is a flowchart illustrating a sequence of a plating processing performed by the plating apparatus according to the exemplary embodiment.

Now, a sequence of a substrate processing according to the exemplary embodiment will be described with reference to FIG. 14 to FIG. 16. FIG. 14 is a flowchart showing a sequence of a plating processing performed by the plating apparatus 1 according to the exemplary embodiment.

First, the controller 51 controls the substrate holder 10 and the like to perform the substrate holding process of holding the wafer W with the holder 12 (process S101). Then, the controller 51 sets one (1) in a counter n configured to count the repetition number of the plating processing (process S102).

Subsequently, the controller 51 controls the processing liquid supply 40 and the like to perform the first supplying process of supplying the plating liquid L1 from the first supply 41 onto the surface of the wafer W (process S103). Then, the controller 51 controls the processing liquid supply 40 and the like to perform the second supplying process of supplying the conductive liquid L2 onto the surface of the wafer W from the second supply 42 (process S104).

Next, the controller 51 controls the plating unit 20, the voltage applying unit 30 and the like to perform the voltage applying process of applying a preset voltage between the wafer W and the conductive liquid L2 (process S105).

Thereafter, the controller 51 makes a determination on whether the counter n is equal to or larger than a predetermined number of times N (process S106). Information regarding this predetermined number of times N is stored in the storage 52 in advance.

Then, if the counter n is equal to or larger than the predetermined number of times N (process S106, Yes), the controller 51 controls the processing liquid supply 40 and the like to perform the substrate cleaning process of supplying the cleaning liquid L3 from the third supply 43 onto the surface of the wafer W (process S107), and the processing is completed.

If, on the other hand, the counter n is not equal to or larger than the predetermined number of times N (process S106, No), the controller 51 increases the counter n for counting the repetition number of the plating processing (process S108), and returns to the process S103.

Figure 15:
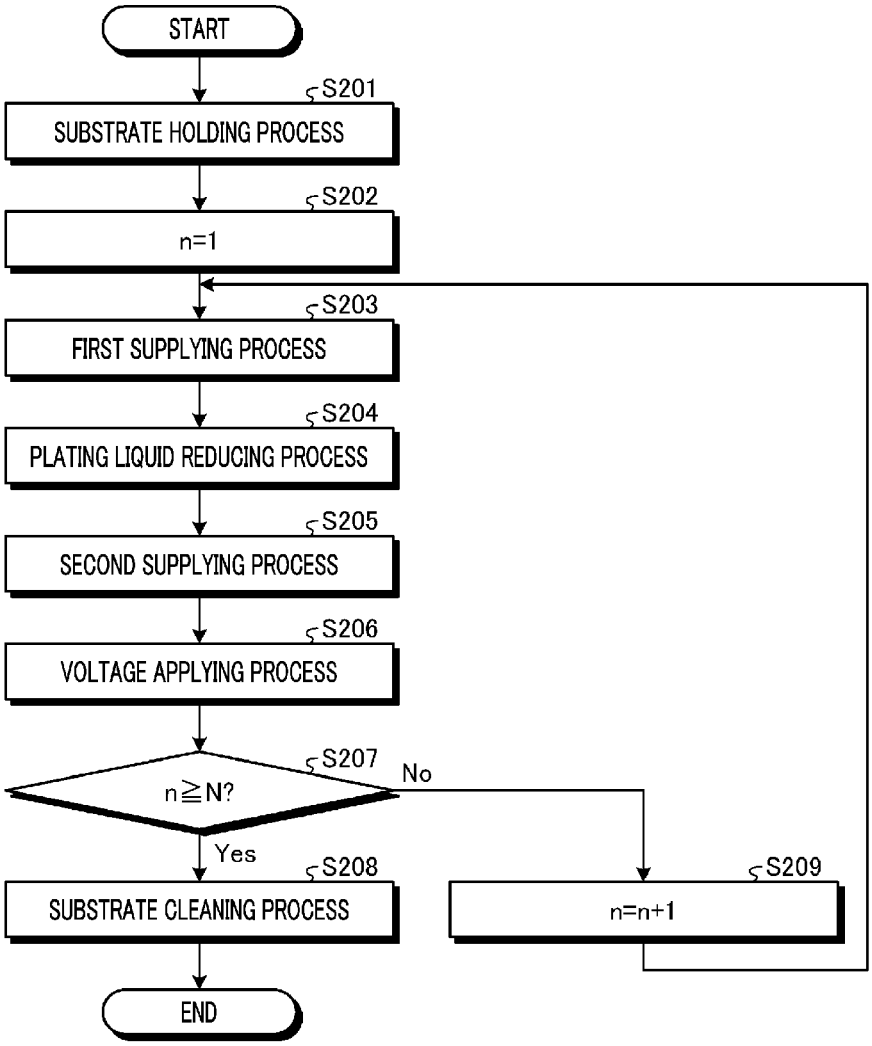
FIG. 15 is a flowchart illustrating another sequence of the plating processing performed by the plating apparatus according to the exemplary embodiment.

FIG. 15 is a flowchart showing another sequence of the plating processing performed by the plating apparatus 1 according to the exemplary embodiment.

First, the controller 51 controls the substrate holder 10 and the like to perform the substrate holding process of holding the wafer W with the holder 12 (process S201). Then, the controller 51 sets one (1) in the counter n for counting the repetition number of the plating processing (process S202).

Next, the controller 51 controls the processing liquid supply 40 and the like to perform the first supplying process of supplying the plating liquid L1 from the first supply 41 onto the surface of the wafer W (process S203). Then, the controller 51 controls the substrate holder 10 and the like to perform the plating liquid reducing process of reducing the plating liquid L1 on the surface of the wafer W (process S204).

Thereafter, the controller 51 controls the processing liquid supply 40 and the like to perform the second supplying process of supplying the conductive liquid L2 onto the surface of the wafer W from the second supply 42 (process S205).

Afterwards, the controller 51 controls the plating unit 20, the voltage applying unit 30 and the like to apply a preset voltage between the wafer W and the conductive liquid L2 (process S206).

Subsequently, the controller 51 makes a determination on whether the counter n is equal to or larger than a predetermined number of times N (process S207). Then, when the counter n is equal to or larger than the predetermined number of times N (process S207, Yes), the controller 51 controls the processing liquid supply 40 and the like to perform the substrate cleaning process of supplying the cleaning liquid L3 from the third supply 43 onto the surface of the wafer W (process S208), and completes the processing.

Meanwhile, if the counter n is not equal to or larger than the predetermined number of times N (process S207, No), the controller 51 increases the counter n for counting the repetition number of the plating processing (process S209), and returns to the process S203.

Figure 16:
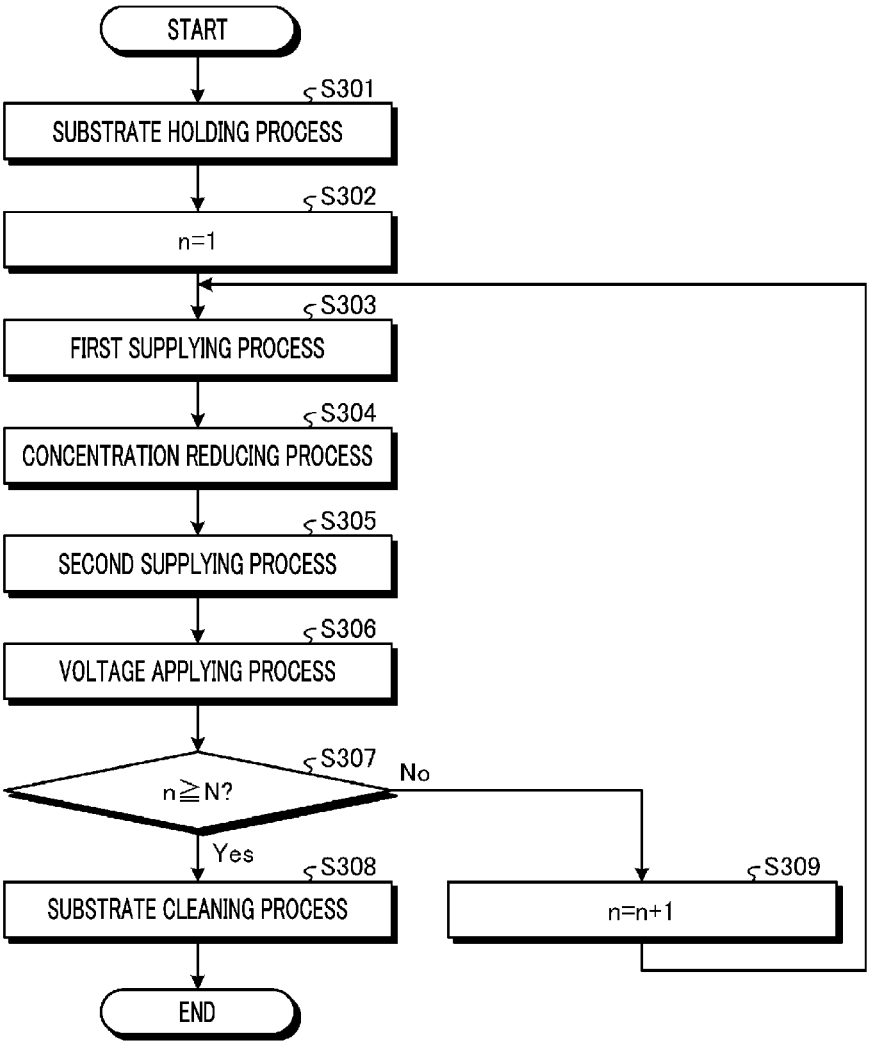
FIG. 16 is a flowchart illustrating yet another sequence of the plating processing performed by the plating apparatus according to the exemplary embodiment.

FIG. 16 is a flowchart showing yet another sequence of the plating processing performed by the plating apparatus 1 according to the exemplary embodiment.

First, the controller 51 controls the substrate holder 10 and the like to perform the substrate holding process of holding the wafer W with the holder 12 (process S301). Then, the controller 51 sets one (1) in the counter n for counting the repetition number of the plating processing (process S302).

Next, the controller 51 controls the processing liquid supply 40 and the like to perform the first supplying process of supplying the plating liquid L1 from the first supply 41 onto the surface of the wafer W (process S303). Then, the controller 51 controls the processing liquid supply 40 and the like to perform the concentration reducing process of reducing the concentration of the plating liquid L1 on the surface of the wafer W (process S304).

Thereafter, the controller 51 controls the processing liquid supply 40 and the like to perform the second supplying process of supplying the conductive liquid L2 onto the surface of the wafer W from the second supply 42 (process S305).

Next, the controller 51 controls the plating unit 20, the voltage applying unit 30 and the like to perform the voltage applying process of applying a preset voltage between the wafer W and the conductive liquid L2 (process S306).

Subsequently, the controller 51 determines whether the counter n is equal to or larger than the predetermined number of times N (process S307). If the counter n is equal to or larger than the predetermined number of times N (process S307, Yes), the controller 51 controls the processing liquid supply 40 and the like to perform the substrate cleaning process of supplying the cleaning liquid L3 from the third supply 43 onto the surface of the wafer W (process S308), and completes the processing.

If, on the other hand, the counter n is not equal to or larger than the predetermined number of times N (process S307, No), the controller 51 increases the counter n for counting the repetition number of the plating processing (process S309), and returns to the process S303.

A plating method according to the exemplary embodiment includes a substrate holding process, a first supplying process, a second supplying process, and a voltage applying process. In the substrate holding process (process S101, S201, or S301), the substrate (wafer W) is held. In the first supplying process (process S103, S203, or S303), the plating liquid L1 is supplied onto the held substrate (wafer W). In the second supplying process (process S104, S205, or S305), the conductive liquid L2 different from the plating liquid L1 is supplied onto the plating liquid L1 supplied on the substrate (wafer W). In the voltage applying process (processes S105, S206, or S306), the voltage is applied between the substrate (wafer W) and the conductive liquid L2. Thus, the inside of the via 60 can be satisfactorily filled with the plating film M.

In addition, the method according to the exemplary embodiment further includes a plating liquid reducing process (process S204) of reducing the plating liquid L1 on the substrate (wafer W) after the first supplying process (process S203). Therefore, the inside of the via 60 can be better filled with the plating film M.

Further, the plating method according to the exemplary embodiment further includes a concentration reducing process (process S304) of reducing the concentration of the plating liquid L1 after the first supplying process (process S303). Accordingly, the inside of the via 60 can be better filled with the plating film M.

Further, in the plating method according to the exemplary embodiment, the first supplying process (process S103, S203, or S303) to the voltage applying process (process S105, S206 or S306) are repeatedly performed in sequence. Accordingly, the inside of the via 60 can be filled with the plating film M securely.

Moreover, in the plating method according to the exemplary embodiment, the specific gravity of the conductive liquid L2 is smaller than that of the plating liquid L1. Accordingly, the inside of the via 60 can be better filled with the plating film M.

Further, in the plating method according to the exemplary embodiment, the conductive liquid L2 is a plating liquid having a smaller content of the main component than the plating liquid L1. Accordingly, it is possible to suppress contamination of the surface of the wafer W or generation of an unintended reaction product due to the conductive liquid L2 during the voltage applying process.

Furthermore, in the plating method according to the exemplary embodiment, the conductive liquid L2 is a liquid containing ammonia or $CO_2$. Accordingly, it is possible to suppress contamination of the surface of the wafer W or generation of an unintended reaction product due to the conductive liquid L2 during the voltage applying process.

So far, the exemplary embodiment of the present disclosure has been described. However, the present disclosure is not limited to the above-described exemplary embodiment, and various changes and modifications may be made without departing from the scope of the present disclosure. By way of example, although the exemplary embodiment has been described for the example where the plating processing is performed on the wafer W having the via 60 formed at the bottom of the trench 61, the plating processing of the present disclosure may be applied to a wafer W having a narrow via 60 formed in a surface thereof, or the like.

Here, it should be noted that the above-described exemplary embodiment is illustrative in all aspects and is not anyway limiting. In fact, the above-described exemplary embodiment can be embodied in various forms. Further, the above-described exemplary embodiment may be omitted, replaced and modified in various ways without departing from the scope and the spirit of claims.

According to the exemplary embodiments, it is possible to fill the via with the plating film successfully.

We claim:

1. A plating method, comprising:

holding a substrate;

supplying a plating liquid onto the held substrate;

reducing the amount of the plating liquid on the substrate by increasing a rotation speed of the substrate after the step of supplying the plating liquid;

after the step of reducing the amount of the plating liquid, supplying a conductive liquid, which is different from the plating liquid supplied on the substrate, onto the plating liquid; and applying a voltage between the substrate and the conductive liquid.

2. The plating method of claim 1, wherein the steps of supplying the plating liquid to applying the voltage are repeatedly performed in sequence.

3. A plating method, comprising:

holding a substrate;

supplying a plating liquid onto the held substrate;

supplying a conductive liquid, which is different from the plating liquid supplied on the substrate, onto the plating liquid; and applying a voltage between the substrate and the conductive liquid, wherein the conductive liquid has a specific gravity smaller than that of the plating liquid.

4. The plating method of claim 3, wherein the conductive liquid is a plating liquid having a smaller content of a main component than the plating liquid.

5. The plating method of claim 3, wherein the conductive liquid is a liquid containing ammonia or $CO_2$.

6. A plating apparatus, comprising:

a substrate holder configured to hold a substrate;

a first supply configured to supply a plating liquid onto the substrate;

a second supply configured to supply a conductive liquid, which is different from the plating liquid, onto the substrate;

a voltage applying unit configured to apply a voltage; and a controller configured to control the substrate holder, the first supply, the second supply and the voltage applying unit, wherein the controller holds the substrate by the substrate holder, supplies the plating liquid onto the held substrate by the first supply, reduces the amount of the plating liquid on the substrate by increasing a rotation speed of the substrate after supplying the plating liquid and after reducing of the amount of the plating liquid, supplies the conductive liquid by the second supply onto the plating liquid supplied on the substrate, and applies the voltage between the substrate and the conductive liquid by the voltage applying unit.

* * * * *